US006123216A

United States Patent [19]

Yokocho et al.

[11] Patent Number: 6,123,216

[45] Date of Patent: Sep. 26, 2000

[54] DOUBLE-CHAMBER TANK AND METHOD OF MANUFACTURING THE SAME

[75] Inventors: Yoetsu Yokocho; Satoru Kikuchi, both of Tokyo, Japan

[73] Assignee: Kioritz Corporation, Tokyo, Japan

[21] Appl. No.: 09/205,272

[22] Filed: Dec. 4, 1998

[30] Foreign Application Priority Data

Dec. 11, 1997 [JP] Japan ..... 9-341758

[51] Int. Cl.[7] ..... B65D 6/00

[52] U.S. Cl. ..... 220/564; 220/4.14

[58] Field of Search ..... 220/564, 501, 220/4.13, 4.14

[56] References Cited

U.S. PATENT DOCUMENTS 3,595,422 7/1971 Durrett, Jr. ..... 220/501 X
4,170,877 10/1979 Pickering ..... 220/501 X
4,217,922 8/1980 Come ..... 220/501 X
5,547,096 8/1996 Kleyn ..... 220/4.14

*Primary Examiner*—Steven Pollard
*Attorney, Agent, or Firm*—Baker Botts L.L.P.

[57] ABSTRACT

A double-chamber tank comprising; a first storage tank and a second storage tank, which are partitioned by a partitioning wall integrally formed therewith; wherein the first storage tank, the second storage tank and the partitioning wall are constituted by a first split counterpart and a second split counterpart, both splitting the first storage tank, the second storage tank and the partitioning wall into one of upper and lower sections, right and left sections, or fore and rear sections; and wherein both of the first split counterpart and second split counterpart are molded by means of an injection molding method, and are bonded with each other through a bonding between a joining edge of the first split counterpart and a joining edge of the second split counterpart, which is effected by means of a vibration welding.

6 Claims, 7 Drawing Sheets

DOUBLE-CHAMBER TANK AND METHOD OF MANUFACTURING THE SAME

BACKGROUND OF THE INVENTION

This invention relates to a double-chamber tank which is capable of separately accommodating gasoline and lubricating oil for instance, and hence suited for use in a portable power working machine. This invention also relates to a method of manufacturing such a double-chamber tank.

In the case of a portable power working machine such as a chain saw, a bush cutter, etc., not only gasoline but also lubricating oil is required to be supplied to an air-cooled two-stroke gasoline internal combustion engine mounted as a power source on the working machine since the engine needs lubricating oil in a separate oiling system or the working portion of the chain saw individually needs lubricating oil. In order to meet such requirements, there has been proposed, as set forth in Japanese Utility Model Publication H/6-21297 and in Japanese Utility Model Unexamined Publication H/6-60737, an idea wherein a tank for gasoline and a tank for lubricating oil are separately produced at first and then subsequently combined so as to be attached to a main body of the working machine by means of a strap, etc.

The aforementioned idea of separately preparing two tanks and subsequently combining them is however accompanied with problems that since two tanks are required to be separately produced, it leads not only to an increase in total manufacturing cost thereof, but also to the consumption of time in assembling as well as mounting them.

Further, a closed type tank whose upper surface is closed such as shown in the aforementioned publications is frequently manufactured by means of a blow molding method. However, the blow molding method is accompanied with problems that a strict weight control of molding material is required, and that even if a molding material is strictly controlled in weight thereof, uneveness in thickness of the molded product tends to be generated so that the external appearance of the molded product is not so good. Furthermore, after the blow molding of these two tanks, a drilling operation of these two tanks for forming an inlet port for pouring fluid such as gasoline, lubricating oil, etc., or for forming fixing portions thereof is required to be performed thus increasing manufacturing steps before these tanks are finally accomplished.

When it is required to accommodate two kinds of fluid in a limited space as in the case of the aforementioned portable power working machine, it may be conceivable to provide the working machine with a double-chamber tank comprising two closed type tanks which are integrated with each other, i.e. a closed type double-chamber tank comprising two tanks, one for accommodating gasoline and the other for accommodating lubricating oil. However, it has been very difficult to manufacture a double-chamber tank of this kind by means of blow molding method, so that no one has succeeded up to date to provide a double-chamber tank which is capable of overcoming the aforementioned problems.

BRIEF SUMMARY OF THE INVENTION

This invention has been made to cope with the aforementioned problems, and therefore an object of the present invention is to provide a double-chamber tank which makes it possible to suppress the manufacturing cost thereof, to dispense with the assembling operation of two tanks, to easily perform the mounting operation of the tank, to obtain a uniform wall thickness exhibiting an excellent external appearance, and to dispense with an additional drilling operation or the like. Another object of the present invention is to provide a method of manufacturing such a double-chamber tank.

With a view to realize the aforementioned objects, the double-chamber tank according to this invention is featured in that it fundamentally comprises a first storage tank and a second storage tank, which are partitioned by a partitioning wall integrally formed with these storage tanks; wherein said first storage tank, said second storage tank and said partitioning wall are constituted by a first split counterpart and a second split counterpart, both splitting said first storage tank, said second storage tank and said partitioning wall into upper and lower sections, right and left sections, or fore and rear sections, and wherein both of said first split counterpart and second split counterpart are molded by means of an injection molding method, and are bonded with each other through a bonding between a joining edge of said first split counterpart and a joining edge of said second split counterpart, which is effected by means of a vibration welding.

In a preferred embodiment of this invention, the joining edge of said first split counterpart and the joining edge of said second split counterpart are constituted by a flat surface which is substantially free from recessed and/or projected portions.

In a preferred embodiment of this invention, said partitioning wall is constituted by a plate portion and a tube portion.

In a further preferred embodiment of this invention, said first split counterpart and said second split counterpart are constituted by those which are obtained by splitting said first storage tank, said second storage tank and said partitioning wall into upper and lower sections, respectively.

In a further preferred embodiment of this invention, an inlet port for a storage fluid or a hole for the attachment of the tank is formed in said first split counterpart as well as in said second split counterpart in concurrent with the injection molding of said first split counterpart and said second split counterpart partition.

As for the material for the first split counterpart and the second split counterpart, preferably a thermoplastic resin, more preferably a transparent or translucent nylon-based resin can be employed.

On the other hand, the method of manufacturing a double-chamber tank according to this invention resides essentially in the utilization of an injection molding method and a vibration welding method. More specifically, the method of manufacturing a double-chamber tank according to this invention comprises the steps of; injection molding a first split counterpart and a second split counterpart separately by making use of a molten synthetic resin, both split counterparts being shaped so as to split a first storage tank, a second storage tank and a partitioning wall separating these storage tanks from each other into upper and lower sections, right and left sections, or fore and rear sections; and fusion-bonding said first split counterpart to said second split counterpart by press-contacting a joining edge of said first split counterpart with a joining edge of said second split counterpart while causing either one of said first split counterpart and said second split counterpart to vibrate relative to the other thereby to generate a frictional heat for fusion-bonding said first split counterpart to said second split counterpart.

In the method of manufacturing a double-chamber tank according to this invention, the first split counterpart and the second split counterpart both constituting the double-chamber tank are separately injection-molded at first, and then bonded to each other by means of a vibration welding method. In this case, the injection molding method is advantageous over a blow molding method in that it makes it possible to dispense with a strict weight control of molding material, to obtain a uniform wall thickness exhibiting an excellent external appearance, to dispense with an additional drilling operation, and to form holes, etc. in concurrent with the aforementioned injection molding. Further, the vibration welding method enables to perform the fusion-bonding of these two split counterparts within a short period of time (generally, 2 to 3 seconds), and to obtain a good-looking liquid-tight sealing between the bonding surfaces.

Therefore, in contrast to the conventional method of separately forming two tanks by means of blow molding method, the method according to this invention enables to dispense with the assembling operation of two tanks, to easily perform the mounting operation of the tank, to reduce the number of manufacturing steps and hence to suppress the manufacturing cost thereof.

DETAILED DESCRIPTION OF THE INVENTION

This invention will be further explained with reference to the drawings depicting one embodiment of this invention.

Figure 1:
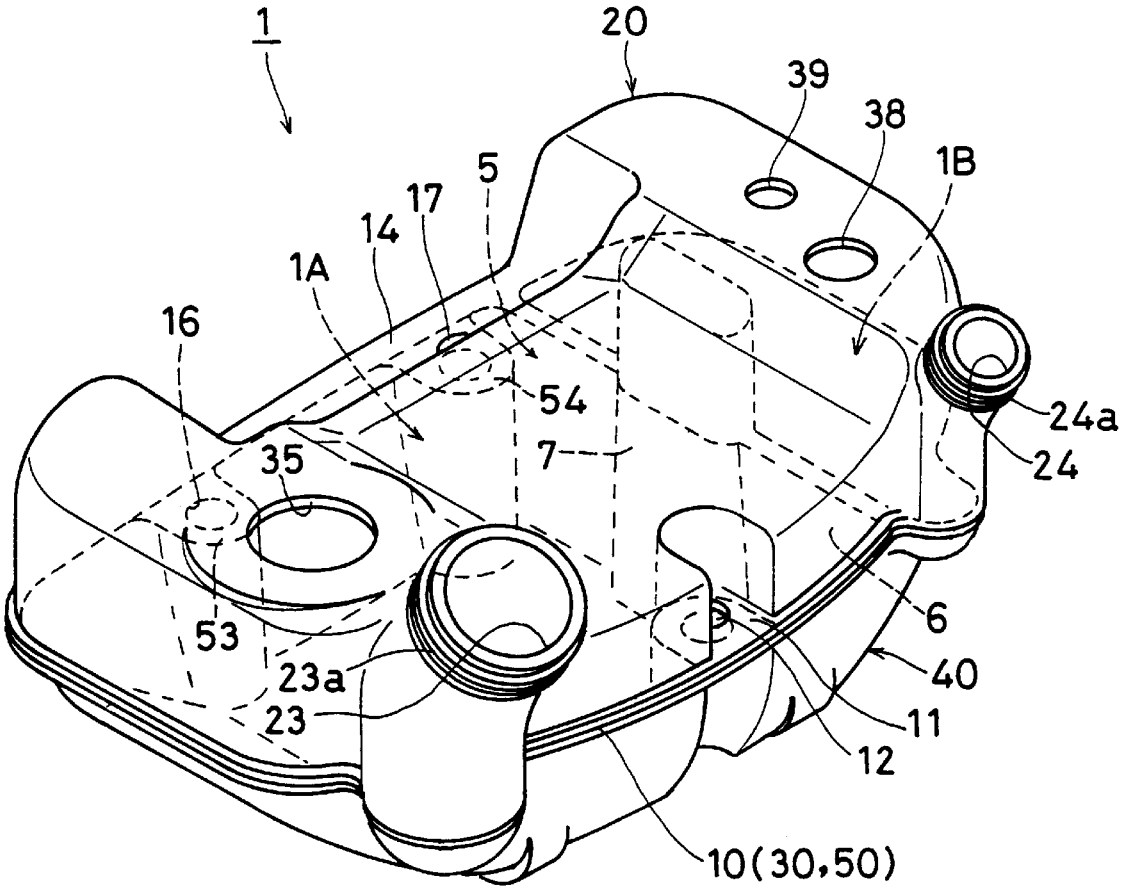
FIG. 1 is a perspective view illustrating one embodiment of a double-chamber tank according to this invention.
Figure 6:
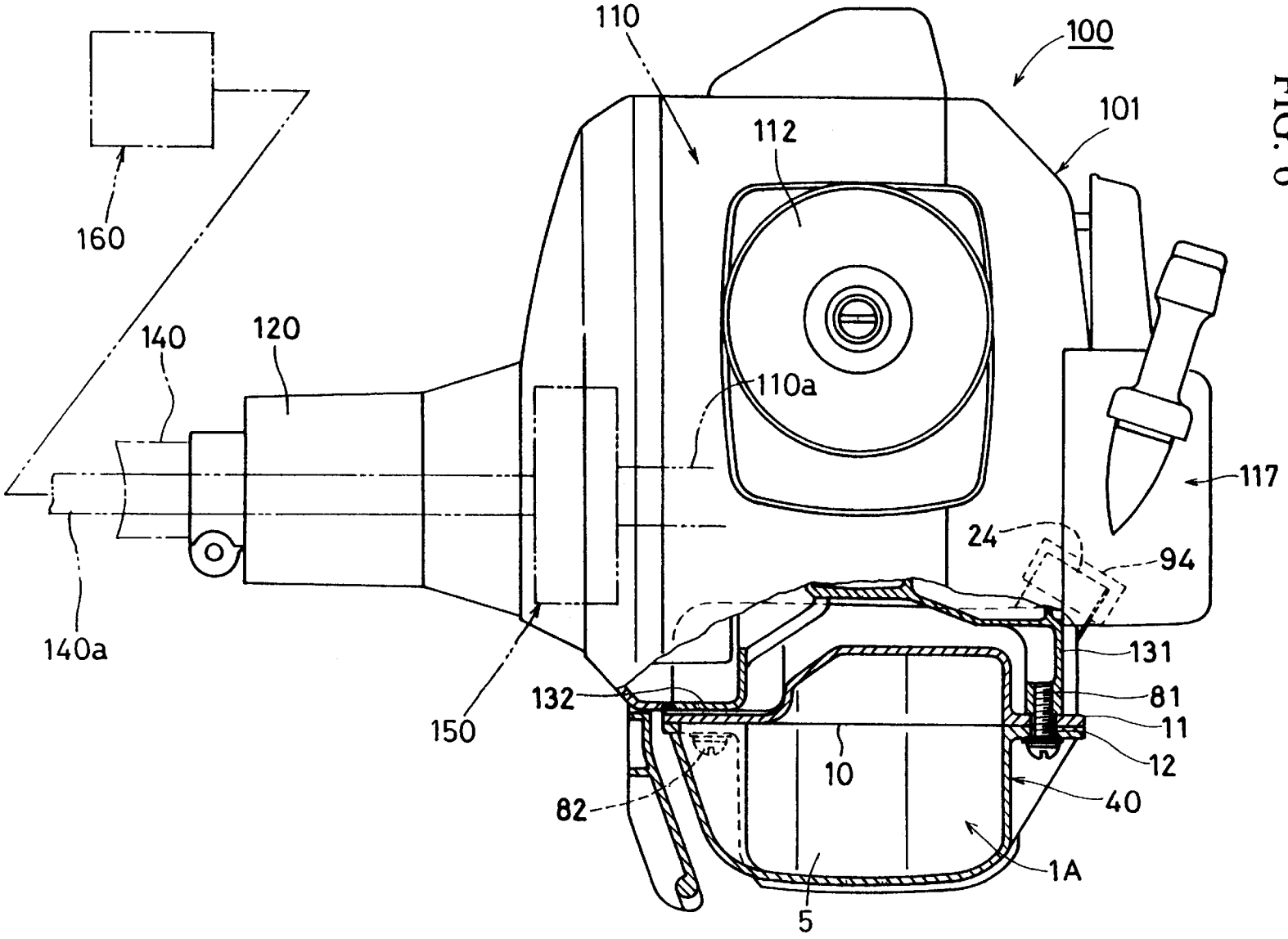
FIG. 6 is a partially sectioned view showing the left side of main portion of a bush cutter provided with the double-chamber tank shown in FIG. 1.
Figure 7:
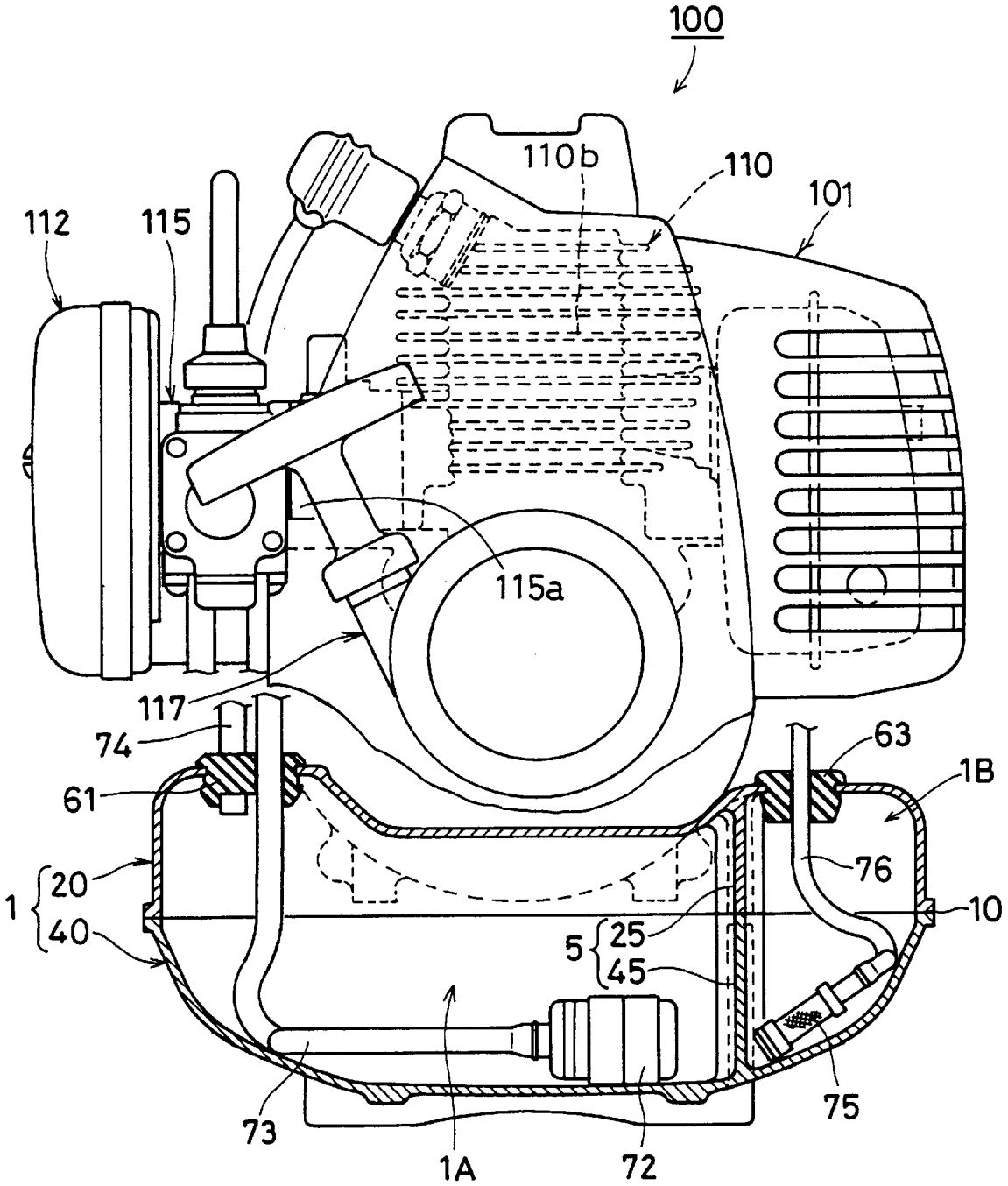
FIG. 7 is a partially sectioned view showing the back of a bush cutter provided with the double-chamber tank shown in FIG. 1.

FIG. 1 shows one embodiment of a double-chamber tank according to this invention. Referring to FIG. 1, the double-chamber tank 1 is designed to be attached as shown in FIGS. 6 and 7 to a lower portion of a prime mover section 101 of a bush cutter 100 representing a portable power working machine. This double-chamber tank 1 essentially comprises a first storage tank 1A of relatively large capacity for storing gasoline as a fuel for an internal combustion engine 110 such as a small air-cooled two-stroke gasoline internal combustion engine, and a second storage tank 1B of relatively small capacity for storing lubricating oil for the internal combustion engine 110, the first storage tank 1A being positioned on the left side of a partitioning wall 5 which is formed integral with the double-chamber tank 1 while the second storage tank 1B being positioned on the right side of the partitioning wall 5.

Figure 2:
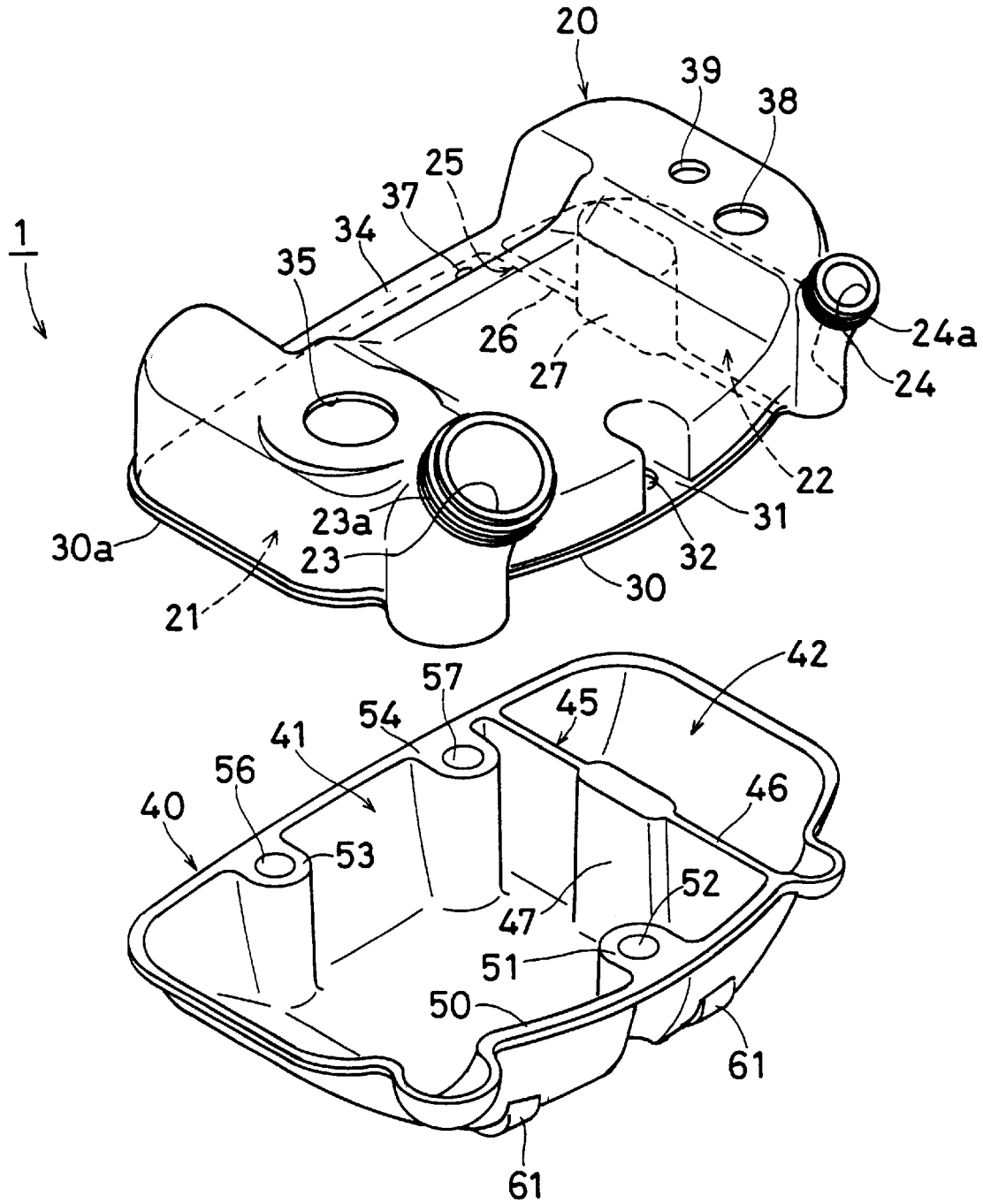
FIG. 2 is a perspective view illustrating an upper split counterpart and a lower split counterpart, both constituting the double-chamber tank shown in FIG. 1.

As shown in FIG. 2, this double-chamber tank 1 is composed of an upper split counterpart 20 and a lower split counterpart 40, both being shaped horizontally partitioning the first storage tank 1A, the second storage tank 1B and the partitioning wall 5 into upper and lower halves. As explained hereinafter, these upper split counterpart 20 and lower split counterpart 40 are separately molded in advance by means of injection molding method, and subsequently bonded to each other through a joining interface 10 by means of vibration welding method. The double-chamber tank 1, i.e. the upper split counterpart 20 and the lower split counterpart 40 are both formed of a transparent or translucent nylon-based thermoplastic resin so as to make it possible to easily recognize the quantity of contents in the double-chamber tank 1.

The first storage tank 1A of the double-chamber tank 1 is provided on its upper surface (on the upper split counterpart 20) with an inlet port 23 for admitting gasoline into the first storage tank 1A. This inlet port 23 is provided at the upper portion thereof with an external thread 23*a* for allowing a cap (not shown) to be engaged therewith. Further as shown in FIG. 7, the first storage tank 1A is provided with a circular hole 35 for allowing a grommet 61 to be attached thereto.

Additionally, as shown in FIG. 6, the double-chamber tank 1 is provided at the fore and rear portions thereof with mounting plate portions 11 and 14 having bolt-holes 12, 16 and 17 and being adapted to be attached by means of bolts 81 and 82 to the mounting portions which are distributed to three bottom portions of the prime mover section 101 of the bush cutter 100 as indicated by 131 and 132 (one of the bottom portions being not shown). The bolt-holes 12, 16 and 17 are respectively constituted by a pair of holes 32 and 52, a pair of holes 28 (see FIGS. 2 and 3) and 56, and a pair of holes 37 and 57, all of which are formed in the upper split counterpart 20 and the lower split counterpart 40, respectively. The mounting plate portions 11 and 14 are also respectively constituted by a pair of mounting plate portions 31 and 51, and a combination of mounting plate portions 34, 53 and 54, all of which are formed in the upper split counterpart 20 and the lower split counterpart 40, respectively.

The second storage tank 1B of the double-chamber tank 1 is provided on its upper surface (on the upper split counterpart 20) with an inlet port 24 for admitting lubricating oil into the second storage tank 1B. This inlet port 24 is provided at the upper portion thereof with an external thread 24*a* for allowing a cap 94 (FIG. 6) to be engaged therewith. Further as shown in FIG. 7, the second storage tank 1B is provided with a circular holes 38 and 39 for allowing a grommet 63 and a breather valve (not shown) to be attached thereto, respectively.

Figure 4:
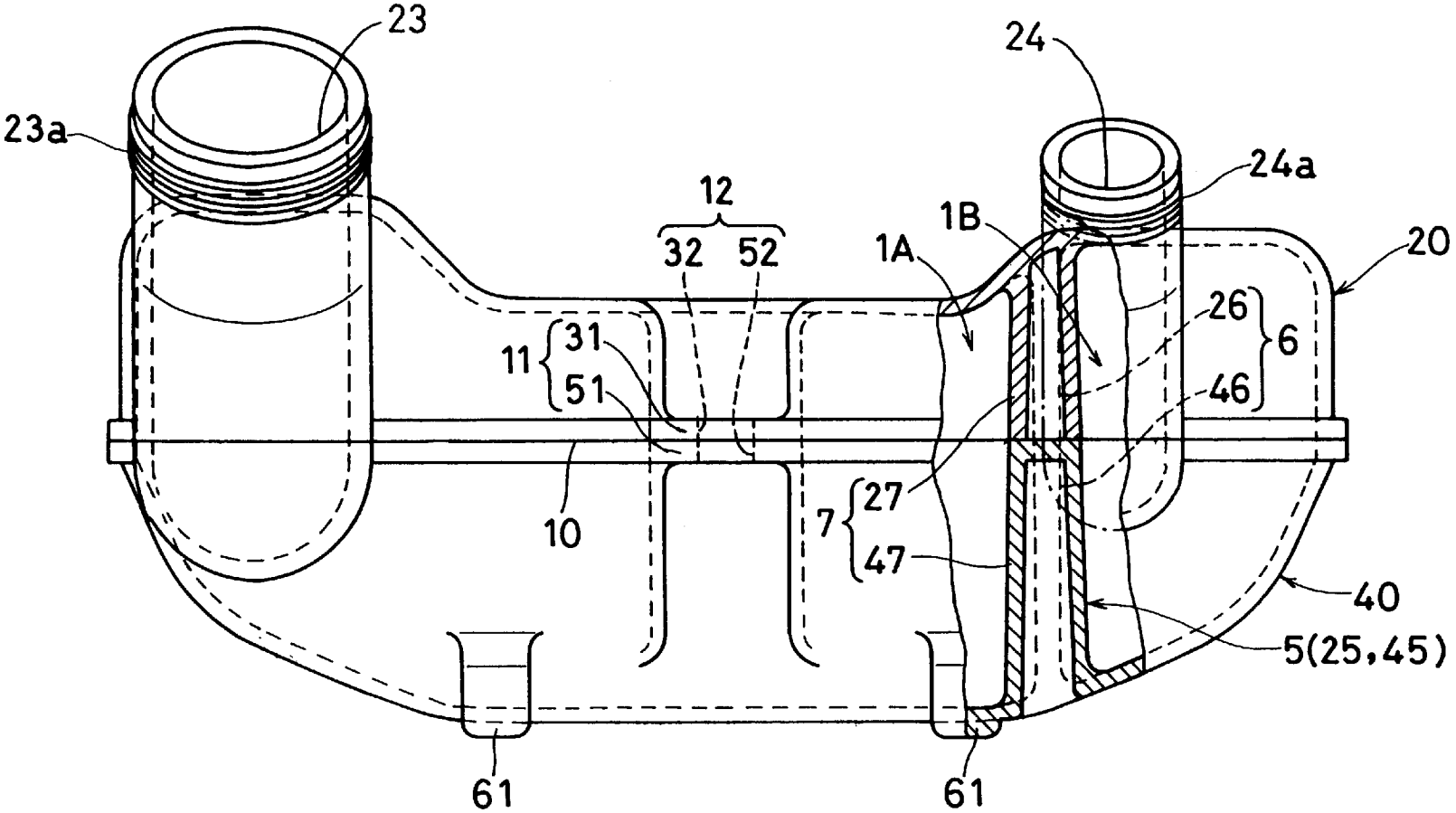
FIG. 4 is a partially sectioned view showing the back of the double-chamber tank shown in FIG. 1.

As clearly shown in FIGS. 4 and 7, the partitioning wall 5 separating the first storage tank 1A from the second storage tank 1B is constituted by a bonded structure consisting of an upper partitioning wall 25 formed in the upper split counterpart 20 and a lower partitioning wall 45 formed in the lower split counterpart 40. The upper partitioning wall 25 is constituted by a pair of plate-like portions 26 and a bottom-less tube portion 27 formed between the plate-like portions 26. Likewise, the lower partitioning wall 45 is constituted by a pair of plate-like portions 46 and a bottom-less tube portion 47 formed between the plate-like portions 46.

Figure 3:
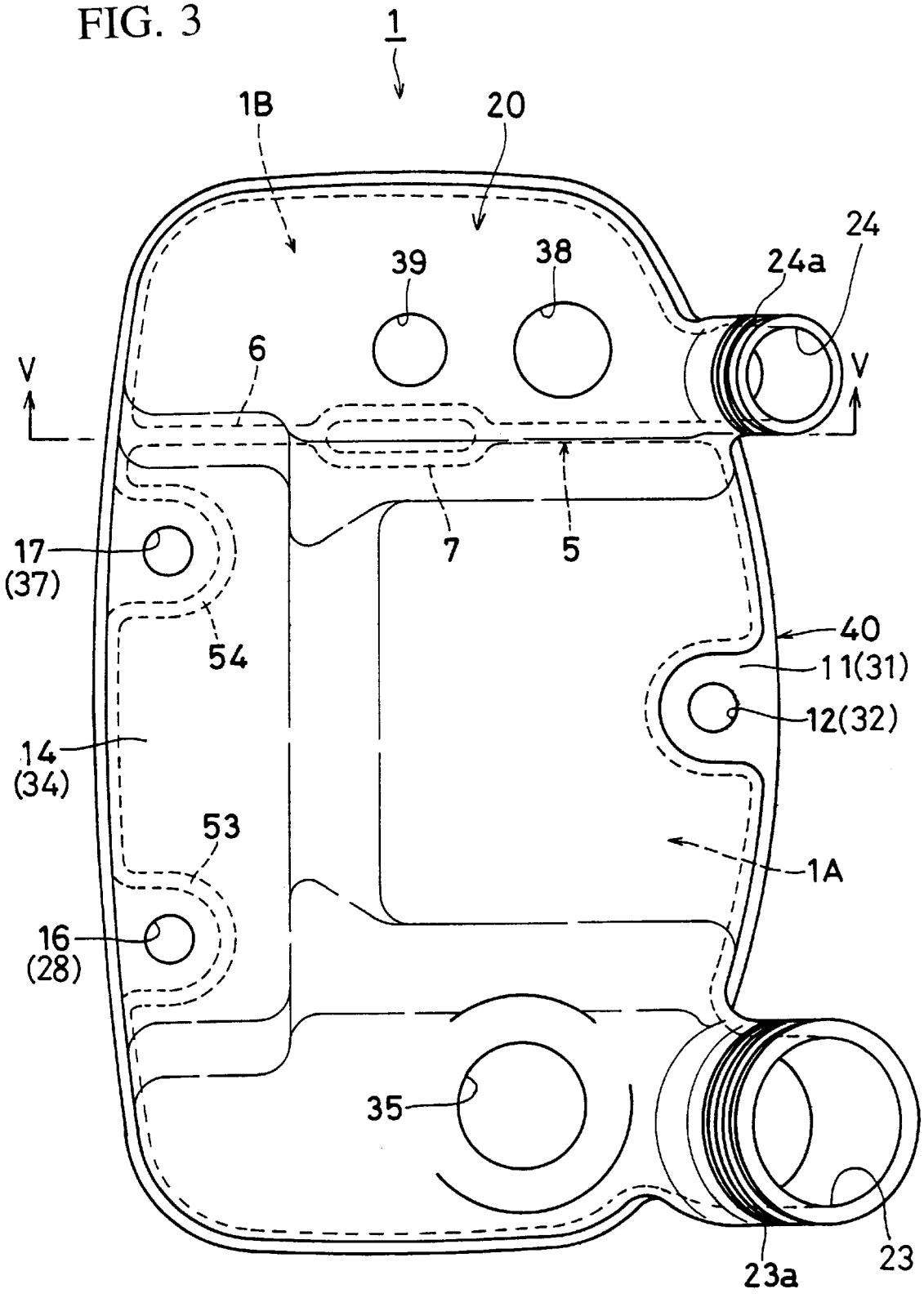
FIG. 3 is a plan view of the double-chamber tank shown in FIG. 1.

As clearly shown in FIGS. 2 and 3, the upper split counterpart 20 is provided with an upper first storage tank 21 having an open bottom and an upper second storage tank 22 having an open bottom, each constituting respectively an upper half of the first storage tank 1A and an upper half of the second storage tank 1B which are partitioned by the upper partitioning wall 25 constituting an upper half of the partitioning wall 5. A bonding end-face 30 (the bottom surface including the bottom surface of the upper partitioning wall 25) of the upper split counterpart 20 is made flat horizontally without substantially accompanying recessed and/or projected portions.

Likewise, the lower split counterpart 40 is provided with a lower first storage tank 41 having an open top and a lower second storage tank 42 having an open top, each constituting respectively a lower half of the first storage tank 1A and a lower half of the second storage tank 1B which are partitioned by the lower partitioning wall 45 constituting a lower half of the partitioning wall 5. A bonding end-face 50 (the upper surface including the upper surface of the lower partitioning wall 45) of the lower split counterpart 40 is made flat horizontally without substantially accompanying recessed and/or projected portions.

The double-chamber tank 1 constructed as mentioned above can be manufactured as follows. First of all, the upper split counterpart 20 and the lower split counterpart 40 are individually molded (monolithic molding) by means of an injection molding. Specifically, although not shown in the drawing, a first injection die and a second injection die, each having a cavity corresponding with the configuration of the upper split counterpart 20 or the lower split counterpart 40, are prepared at first, and then a molten resin such as transparent or translucent nylon-based resin is injected at a high pressure into the cavity of each injection die thereby to obtain the upper split counterpart 20 and the lower split counterpart 40, individually. By the way, the aforementioned various kinds of hole and inlet ports {12 (32, 52), 16 (36, 56), 17 (37, 57), 23, 24, 35, 38, 39} can be formed simultaneous with this injection molding step.

Thereafter, the bonding end-face 30 of the upper split counterpart 20 is press-contacted with the bonding end-face 50 of the lower split counterpart 40 at a suitable degree of static pressure, under the condition of which either one of the first split counterpart 20 and the second split counterpart 40 is vibrated relative to the other at a suitable vibration frequency for a short period of time (generally, 2 to 3 seconds). As a result, due to a frictional heat, the bonding end-face 30 of the upper split counterpart 20 is caused to fusion-bond (the joining interface 10) with the bonding end-face 50 of the lower split counterpart 40, thus obtaining the integrated double-chamber tank 1 as shown in FIG. 1.

The double-chamber tank 1 thus manufactured is then mounted on the bottom of the prime mover section 101 of the bush cutter 100 by screwing the bolts 81 and 82, through the bolt-holes 12, 16 and 17, into the mounting brackets 131 and 132 (one of the bottom portions being not shown) which are provided at three portions of the bottom of the prime mover section 101, with the aforementioned grommets 61 and 63 being fitted in the holes 35, 38 and 39 as shown in FIGS. 6 and 7.

This bush cutter 100 is constructed such that the air-cooled two-stroke gasoline internal combustion engine 110 is mounted inside the prime mover section 101 with the cylinder of the engine 110 being vertically disposed, that a carburetor 115 and an air cleaner 112 are disposed on the left side of the engine 110, that a recoil starter 117 is placed at the rear end of crank shaft 110*a* of the engine 110, and that a drive shaft 140*a* inserted into a manipulating rod 140 (FIG. 6) is connected via a centrifugal clutch 150 with the fore end of the crank shaft 110*a*. Further, a cutter unit 160 functioning as a cut-working member is mounted at the distal end portion of the manipulating rod 140 and is adapted to be rotationally driven, via the drive shaft 140*a*, by the engine 110.

It is designed such that the gasoline stored in the first storage tank 1A of the double-chamber tank 1 is fed, through a strainer 72 and a flexible feed pipe 73 which is passed through and held by the grommet 61, to the carburetor 115, and that any redundant gasoline can be returned, via a return pipe 74 which is passed through and held by the grommet 61, to the first storage tank 1A. On the other hand, the lubricating oil stored in the second storage tank 1B of the double-chamber tank 1 is fed, through an oil strainer 75, a flexible oil pipe 76 which is passed through and held by the grommet 63 and an oil pump (not shown), to a insulator pipe 115*a* interposed between the carburetor 115 and the cylinder 110*b* of the engine 110, and that any redundant lubricating oil can be returned, via a return pipe (not shown), to the second storage tank 1B. This lubricating oil thus fed to the insulator pipe 115*a* is then transferred together with an air-fuel mixture to the interior of the engine 110 so as to lubricate the sliding members of the engine 110.

As explained above, in the double-chamber tank 1 of this embodiment and the manufacturing method thereof, the upper split counterpart 20 and the lower split counterpart 40 each constituting the double-chamber tank 1 are individually manufactured by means of an injection molding method, and subsequently bonded together by means of a vibration welding method.

In this case, this injection molding method is advantageous over a blow molding method in that it makes it possible to obtain a precisely uniform wall thickness exhibiting an excellent external appearance, to dispense with an additional drilling operation, and to form holes, etc. in concurrent with the injection molding. Further, the vibration welding method enables to perform the fusion-bonding of these two split counterparts 20 and 40 within a short period of time (generally, 2 to 3 seconds), and to obtain a good-looking liquid-tight sealing portion 10 (between the bonding faces 30 and 50).

Therefore, in contrast to the conventional method of separately forming two tanks by means of the blow molding method, the method according to this embodiment enables to dispense with the assembling operation of two tanks, to easily perform the mounting operation of the tank onto a main body of a working machine, to facilitate the sub-assembling of pipes and grommets, to reduce the number of manufacturing steps and hence to suppress the manufacturing cost thereof.

Since the partitioning wall 5 is provided with the tube portion 7, not only the partitioning wall 5 is reinforced by the tube portion 7, but also any deflection between the upper partitioning wall 25 of the upper split counterpart 20 and the lower partitioning wall 45 of the lower split counterpart 40 can be more effectively suppressed at the occasion of the vibration welding as compared with the case where this tube portion 7 is not existed at all. Additionally, this tube portion 7 can be utilized as a tool hanging portion at the occasion of working or assembling the double-chamber tank 1.

Figure 5:
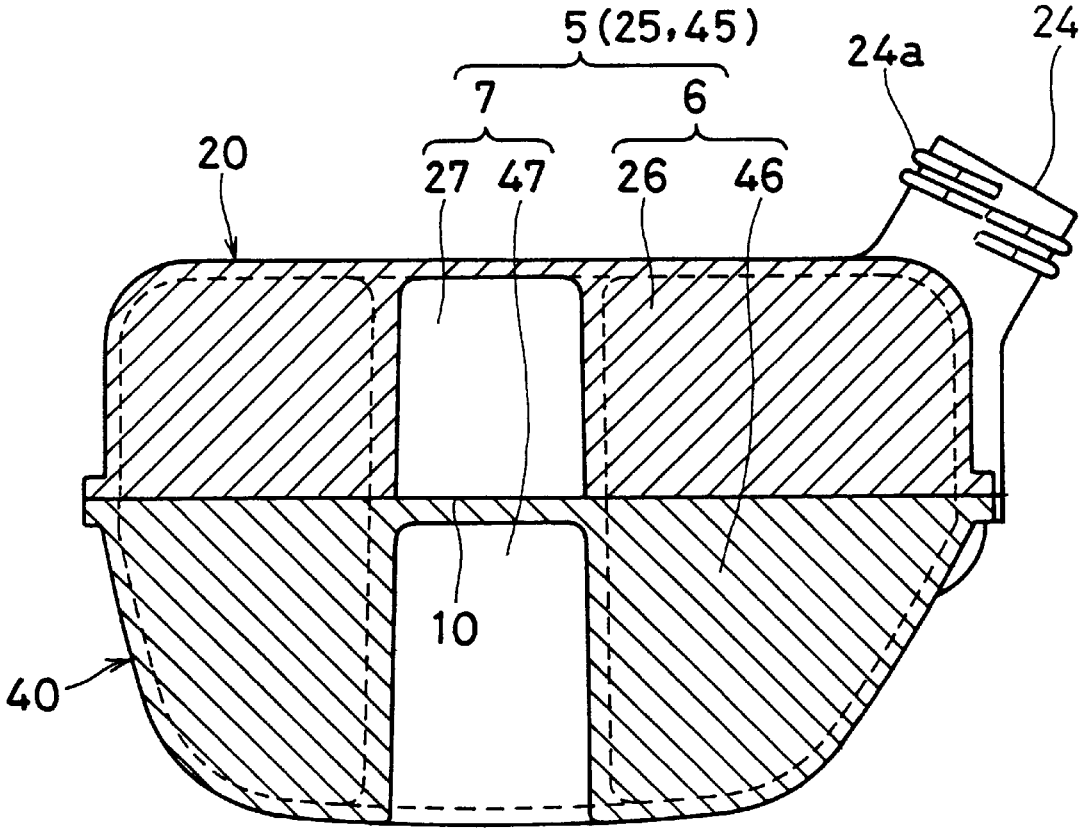
FIG. 5 is a cross-sectional view taken along the line V—V of FIG. 3.

Although the tube portion 7 does not constitute a vertical through-hole, i.e. the tube portions 27 and 47 of these upper split counterpart 20 and lower split counterpart 40 are both closed at the top thereof as shown in FIGS. 4 and 5, the tube portions 27 and 47 of these upper split counterpart 20 and lower split counterpart 40 may be respectively formed of a through-hole, thus forming a vertical through-hole and making it possible to utilize the tube portions 27 and 47 as a passageway allowing a wiring or piping to pass therethrough.

Although this invention has been explained with reference to one embodiment thereof, it will be understood that the construction of the embodiment can be modified in various ways without departing from the spirit and scope of the invention.

For example, although the aforementioned double-chamber tank is designed to store gasoline and lubricating oil to be used in a portable power working machine, the double-chamber tank can be also utilized for other end-uses.

Further, although the aforementioned two split counterparts 20 and 40 are shaped such that can be obtained as the entire body of the double-chamber tank is horizontally partitioned into upper and lower halves. However, the aforementioned two split counterparts 20 and 40 may be shaped such that can be obtained as the entire body of the double-chamber tank is split into either right and left sections, or into fore and rear sections.

As clearly understood from the above explanations, the double-chamber tank and the manufacturing method thereof according to this invention are advantageous over the conventional method where two tanks are separately molded by means of a blow molding method in that the double-chamber tank and manufacturing method of this invention make it possible to suppress the manufacturing cost thereof, to dispense with the assembling operation of two tanks, to easily perform the mounting operation of the tank, to dispense with the strict weight control of a molding raw material, to obtain a uniform wall thickness exhibiting an excellent external appearance, and to dispense with an additional drilling operation.

What is claimed is:

1. A double-chamber tank comprising a first storage tank and a second storage tank, which are partitioned by a partitioning wall integrally formed with said storage tanks;

wherein said first storage tank, said second storage tank and said partitioning wall are constituted by a first split counterpart and a second split counterpart, both splitting said first storage tank, said second storage tank and said partitioning wall into two sections;

wherein both said first split counterpart and second split counterpart are molded separately by means of an injection molding method and are bonded with each other through a bonding between a joining edge of said first counterpart and a joining edge of said second split counterpart, which is effected by means of vibration welding;

wherein the joining edge of said first counterpart and the joining edge of said second split counterpart are constituted by a flat surface that is substantially planar and free from recesses or projections, and wherein the partitioning wall includes a plate portion and a tube portion.

2. The double-chamber tank according to claim 1, wherein said first split counterpart and second split counterpart form upper and lower sections of said first storage tank, said second storage tank and said partitioning wall.

3. The double-chamber tank according to claim 2, wherein an inlet port for a storage fluid is formed in the split counterpart that forms the upper section upon the injection-molding thereof.

4. The double-chamber tank according to claim 2, wherein a hole for mounting the double-chamber tank is formed in the split counterpart that forms the lower section upon the injection-molding thereof.

5. The double-chamber tank according to claim 1, wherein said first split counterpart and said second split counterpart are formed of a transparent or translucent nylon-based resin.

6. A method of molding a double-chamber tank having a first storage tank and a second storage tank, which are partitioned by a partitioning wall integrally formed with said storage tanks, the method comprising the steps of separately injection-molding a first split counterpart and a second split counterpart, each split counterpart forming a section of said first storage tank, said storage tank and said partitioning wall, the partitioning wall of each section including a plate portion and a tube portion;

press-contacting said counterparts with each other along a joining edge of said first counterpart and a joining edge of said second split counterpart, each said joining edge being constituted by a flat surface that is substantially planar and free from recesses or projections, and causing one of the sections to vibrate relative to the other section to thereby generate heat by friction for effecting fusion-bonding of said first split counterpart to a second split counterpart.

* * * * *